US008686916B2

(12) United States Patent
Yukimasa et al.

(10) Patent No.: US 8,686,916 B2
(45) Date of Patent: Apr. 1, 2014

(54) LOOP ANTENNA

(75) Inventors: Koji Yukimasa, Yokohama (JP); Hidetada Nago, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 13/172,532

(22) Filed: Jun. 29, 2011

(65) Prior Publication Data

US 2012/0013513 A1 Jan. 19, 2012

(30) Foreign Application Priority Data

Jul. 13, 2010 (JP) ..... 2010-159166
May 26, 2011 (JP) ..... 2011-118398

(51) Int. Cl.
*H01Q 11/12* (2006.01)

(52) U.S. Cl.
USPC ..... 343/866; 343/741; 343/702

(58) Field of Classification Search
USPC ..... 343/741, 866
See application file for complete search history.

(56) References Cited

U.S. PATENT DOCUMENTS

| | | | | |
|---|---|---|---|---|
| 6,078,609 | A | 6/2000 | Nago | |
| 6,992,630 | B2 * | 1/2006 | Parsche | 343/700 MS |
| 2010/0165964 | A1 | 7/2010 | Nago | |
| 2010/0189057 | A1 | 7/2010 | Nago | |
| 2010/0268801 | A1 | 10/2010 | Yukimasa | |

FOREIGN PATENT DOCUMENTS

| | | | | |
|---|---|---|---|---|
| JP | 9148838 | * 11/1995 | | H01Q 1/38 |
| JP | 9-148838 | A 6/1997 | | |
| JP | 2006-295545 | A 10/2006 | | |

OTHER PUBLICATIONS

R.L.Li, G.DeJean, J.Laskar and M.M.Tentzeris, "Investigation of Circularly Polarized Loop Antennas with a Parasitic Element for Bandwidth Enhancement", Dec. 2005, IEEE Transactions on Antennas and Propagation, vol. 53, No. 12, pp. 3930-3939.*

* cited by examiner

*Primary Examiner* — Jerome Jackson, Jr.
*Assistant Examiner* — Michael Bouizza
(74) *Attorney, Agent, or Firm* — Fitzpatrick, Cella, Harper & Scinto

(57) ABSTRACT

A loop antenna includes a parasitic element arranged at a position almost concentric to a loop element and having an opening portion smaller than the half perimeter of the loop element at a position opposite to the feeding point of the loop element.

6 Claims, 15 Drawing Sheets

DIRECTIONAL CHARACTERISTICS OF CIRCULAR LOOP ANTENNA USING FR4 WHEN $\phi$ = 300deg, $W_L$ = 1mm, $W_p$ = 3mm, AND t = 1mm AT 2.45GHz DIRECTIONAL CHARACTERISTICS OF CIRCULAR LOOP ANTENNA USING FR4 WHEN
$\phi$ = 316deg, $W_L$ = 1mm, $W_p$ = 3mm, AND t = 1mm AT 2.45GHz DIRECTIONAL CHARACTERISTICS OF STAND-ALONE CIRCULAR LOOP ANTENNA WHEN $W_L$ = 1mm, $W_p$ = 3mm, AND t = 1mm AT 2.45GHz DIRECTIONAL CHARACTERISTICS OF CIRCULAR LOOP ANTENNA USING TEFLON WHEN $\phi$ = 350deg, $W_L$ = 1mm, $W_p$ = 3mm, AND t = 1mm AT 2.45GHz DIRECTIONAL CHARACTERISTICS OF CIRCULAR LOOP ANTENNA USING FR4 WHEN $\phi$ = 316deg, $W_L$ = 1mm, $W_p$ = 3mm, AND t = 1mm AT 5GHz

ILLUSTRATION OF OCTAGONAL LOOP + PARASITIC ELEMENT

FR4 OCTAGONAL + PARASITIC ELEMENT, RADIUS SWEEP ANALYSIS AT 2 GHz

DIRECTIONAL CHARACTERISTICS OF OCTAGONAL LOOP ANTENNA USING FR4 + PARASITIC ELEMENT WHEN $\phi$ = 294deg, $W_L$ = 1mm, $W_p$ = 3mm, AND t = 1mm AT 2.45GHz DIRECTIONAL CHARACTERISTICS OF CIRCULAR LOOP ANTENNA USING TEFLON WHEN $\phi$ = 350deg, $W_L$ = 1mm, $W_P$ = 3mm, AND t = 1mm AT 2.45GHz

LOOP ANTENNA

BACKGROUND OF THE INVENTION

1. Field of the Invention

The present invention relates to a loop antenna used in a wireless communication apparatus.

2. Description of the Related Art

Wireless communication technology has recently received a great deal of attention, and even small apparatuses such as digital cameras are equipped with a circuit and an antenna for wireless communication. To equip a small apparatus such as a digital camera with a wireless communication circuit and antenna, the circuit and the antenna need to be smaller. For example, the antenna is implemented on a dielectric substrate to reduce cost and size.

Examples of related arts of a loop antenna with a parasitic element arranged near it include patent references 1 and 2. In patent reference 1, a parasitic element about ¼ the wavelength is arranged near the loop antenna, thereby broadening the communication frequency bandwidth. Patent reference 2 discloses three types of parasitic element shape. In the first shape, a parasitic element having an opening portion on the feeding side of the loop element is arranged to change the resonance frequency and improve the gain. In the second shape, a parasitic element having no opening portion is arranged to change the characteristic impedance. In the third shape, a window-shaped parasitic element is arranged to lower the resonance frequency.

[Patent Reference 1] Japanese Patent Laid-Open No. 2006-295545

[Patent Reference 2] Japanese Patent Laid-Open No. 09-148838

A high-frequency circuit in a wireless communication apparatus is generally designed to have a characteristic impedance of 50Ω. The input impedance of a loop antenna having a basic shape is 75Ω. For this reason, when the loop antenna is directly connected to the 50Ω a high-frequency circuit, impedance mismatch occurs, and no satisfactory characteristics can be obtained. Satisfactory characteristics can be obtained by a loop antenna whose input impedance is 75Ω. To convert the characteristic impedance of the high-frequency circuit of the wireless communication apparatus from 50Ω to 75Ω, an impedance conversion unit (balun) needs to be provided on the preceding stage of the input to the antenna.

SUMMARY OF THE INVENTION

The present invention provides a loop antenna connectable to a circuit having an impedance characteristic of a predetermined value such as 50Ω without providing an impedance conversion unit.

According to one aspect of the present invention, there is provided a loop antenna comprising: a loop element arranged on one surface of a dielectric substrate and having a feeding point; and a parasitic element arranged, on the other surface which is a surface on the other side of the one surface of the dielectric substrate, to be substantially concentric to the loop element and having an opening portion smaller than a half perimeter of the loop element, the opening portion being formed at a position opposite to a position where the feeding point is provided.

According to another aspect of the present invention, there is provided a loop antenna comprising: a loop element having a feeding point; and a parasitic element arranged at a position opposite to a loop surface of the loop element and substantially concentric to the loop element and having an opening portion smaller than a half perimeter of the loop element, the opening portion being formed at a position on a loop perimeter opposite to a position where the feeding point is provided on the loop perimeter of the loop element.

According to the present invention, it is possible to provide a loop antenna connectable to a circuit having a different impedance characteristic without providing an impedance conversion unit.

Further features of the present invention will become apparent from the following description of exemplary embodiments (with reference to the attached drawings).

DESCRIPTION OF THE EMBODIMENTS

First Embodiment

Figure 1A:
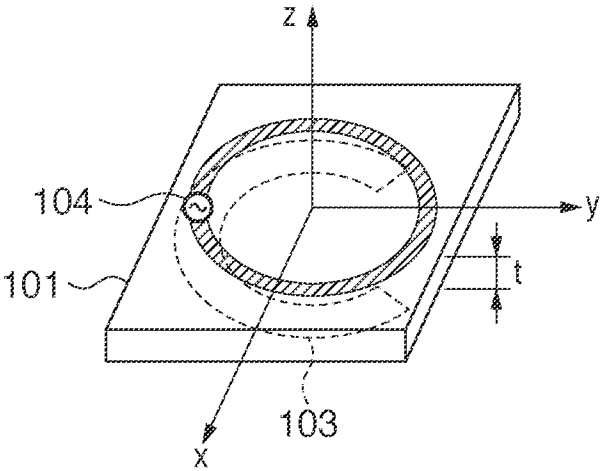
FIGS. 1A to 1C are views for explaining the arrangement of a loop antenna according to the first embodiment.
Figure 1B:
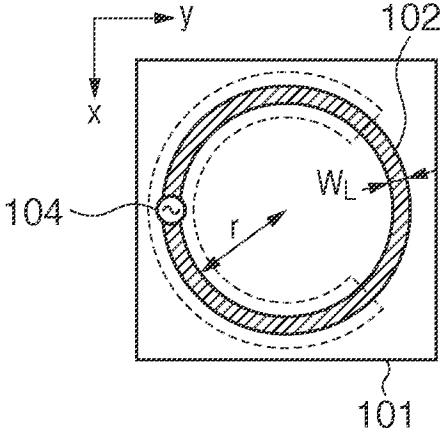
Figure 1C:
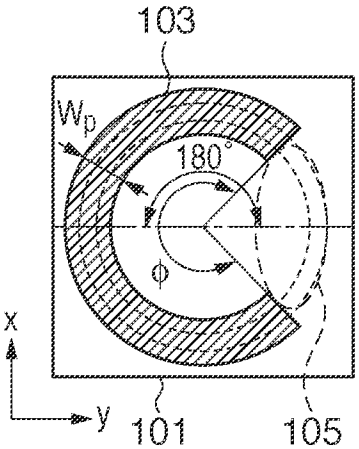

The arrangement of a loop antenna according to the first embodiment will be described with reference to FIGS. 1A to 1C. A circular loop element (to be simply referred to as a loop element hereinafter) 102 of a conductor is arranged (FIG. 1B) on one surface (upper surface) of a dielectric substrate 101 (FIG. 1A). A circular parasitic element (to be simply referred to as a parasitic element hereinafter) 103 of a conductor is arranged (FIG. 1C) on the other surface (lower surface) on the other side of the one surface. The parasitic element 103 and the loop element 102 are arranged such that the line connecting the center point of the parasitic element 103 on the x-y plane and that of the loop element 102 on the x-y plane guarantees an almost concentric relationship and is perpendicular to the surfaces of the dielectric substrate 101. Note that the line connecting the center point of the parasitic element 103 on the x-y plane and that of the loop element 102 on the x-y plane can guarantee a concentric relationship but may be misaligned slightly. The misalignment amount applicable in the present invention changes depending on the radius, width, material, and the like of the loop element. The parasitic element 103 has an opening portion 105 at a position (a position shifted by 180°) opposite to the position of a feeding point 104 of the loop element 102. A radius r indicates the loop radius of the loop element 102, and a width WL indicates the loop width of the loop element 102. An angle Φ indicates the opening angle of the parasitic element 103, and a width Wp indicates the width of the parasitic element 103. A thickness t indicates the thickness of the dielectric substrate 101.

As the dielectric substrate 101, for example, glass epoxy is usable, and its relative dielectric constant is 4.4. As for the frequency of the loop antenna, the desired frequency bandwidth is set to 2.4 to 2.5 GHz that is the frequency bandwidth of IEEE802.11b/g.

A method of setting the parameters of the loop antenna according to this embodiment will be described next. The parameter setting method has three steps. In the first step, the loop radius r is set. In this step, the loop radius r of the loop element 102 is determined from the reflection characteristic of the loop element 102 and the dielectric substrate 101 without arranging the parasitic element 103.

Figure 2A:
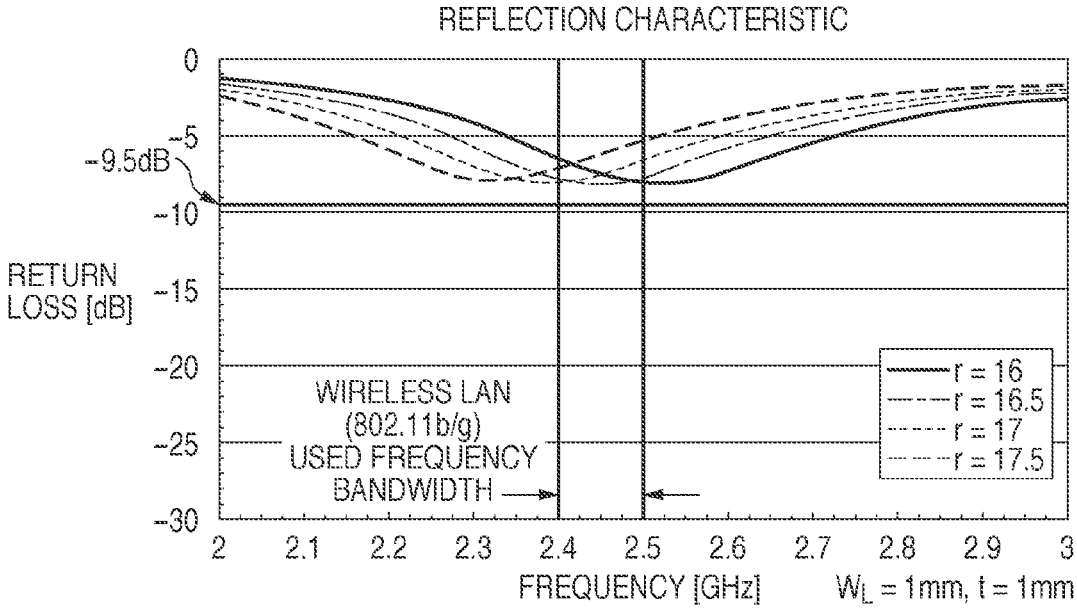
FIG. 2A is a graph showing the simulation result of the reflection characteristic of the loop antenna obtained by changing the loop radius r.
Figure 2B:
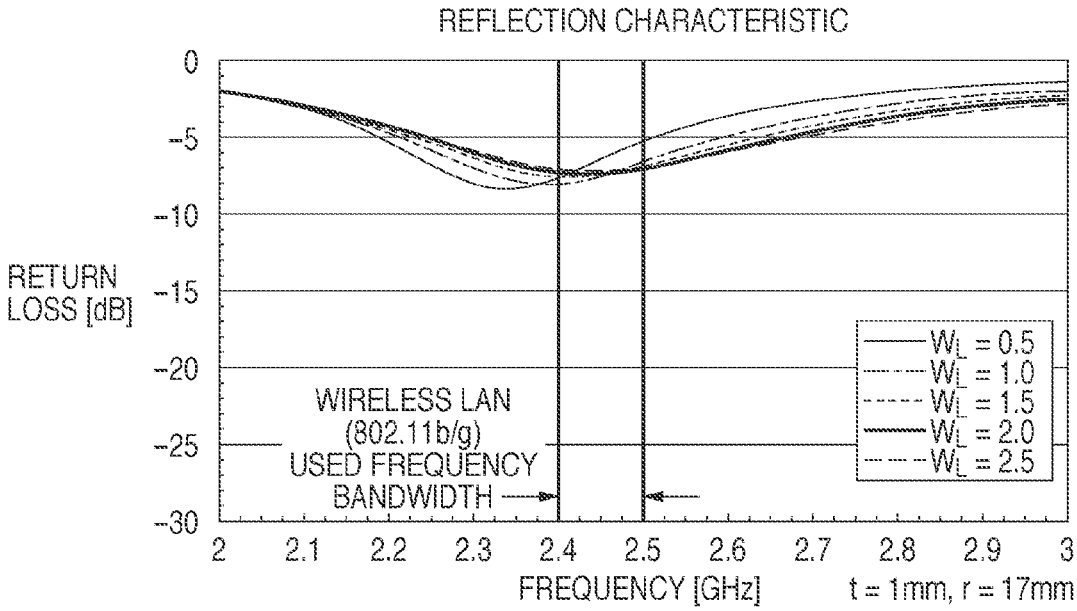
FIG. 2B is a graph showing the simulation result of the reflection characteristic of the loop antenna obtained by changing the width $W_L$ of a loop element.

FIGS. 2A and 2B show the simulation results of the reflection characteristic when a loop element having an input impedance of 75Ω is connected to a high-frequency circuit having a characteristic impedance of 50Ω, and no parasitic element is arranged. A return loss of −9.5 dB is equivalent to a VSWR (Voltage Standing Wave Ratio) of "2". This indicates that approximately 90% the input power is supplied to the antenna. In this embodiment, a VSWR of "2" (return loss: −9.5 dB) or less is set as an index for ensuring the satisfactory characteristic of the loop antenna. As is apparent from FIGS. 2A and 2B, when the loop element having an input impedance of 75Ω is connected to the high-frequency circuit having a characteristic impedance of 50Ω, and no parasitic element is arranged, the value of VSWR exceeds 2 (return loss: −9.5 dB), and no satisfactory reflection characteristic is obtained.

FIG. 2A shows the simulation result of the reflection characteristic of the loop antenna obtained by changing the loop radius r. The thickness of the dielectric substrate 101 is t=1 mm. When the parasitic element 103 is arranged as in FIGS. 1A and 1C, the resonance frequency rises by 5% to 10%. For this reason, the loop radius r is determined such that the resonance frequency is set to a frequency lower than the center frequency of the desired frequency bandwidth by 5% to 10% without arranging the parasitic element 103. As can be seen from FIG. 2A, for example, the loop radii that cause the loop antenna to resonate at a frequency of 2.35 GHz lower than 2.45 GHz that is the center frequency of the desired frequency bandwidth by about 5% (about 100 MHz) are r=17 mm and r=17.5 mm. The loop radius r=17 mm is determined to be used in the following description. The length (loop radius) of the loop element is the length at which the loop antenna resonates at a frequency lower than the used frequency without a parasitic element (a frequency lower by 5% to 10%).

In the second step, the loop width $W_L$ is determined. FIG. 2B shows the simulation result of the reflection characteristic of the loop antenna obtained by changing the width $W_L$ of the loop element when the thickness t of the dielectric substrate 101 is 1 mm, and the loop radius r is 17 mm. As can be seen from FIG. 2B, the loop element widths that cause the loop antenna to resonate at a frequency of 2.35 GHz lower than 2.45 GHz that is the center frequency of the desired frequency bandwidth by about 5% (about 100 MHz) are $W_L$=0.5 mm and $W_L$=1.0 mm. When $W_L$=1.5 to 2.5 mm, the resonance frequency is higher than the desired frequency bandwidth 2.35 GHz. $W_L$=1 mm is determined to be used in the following description as the loop width that causes the loop antenna to resonate at a frequency in the desired frequency bandwidth.

Figure 3A:
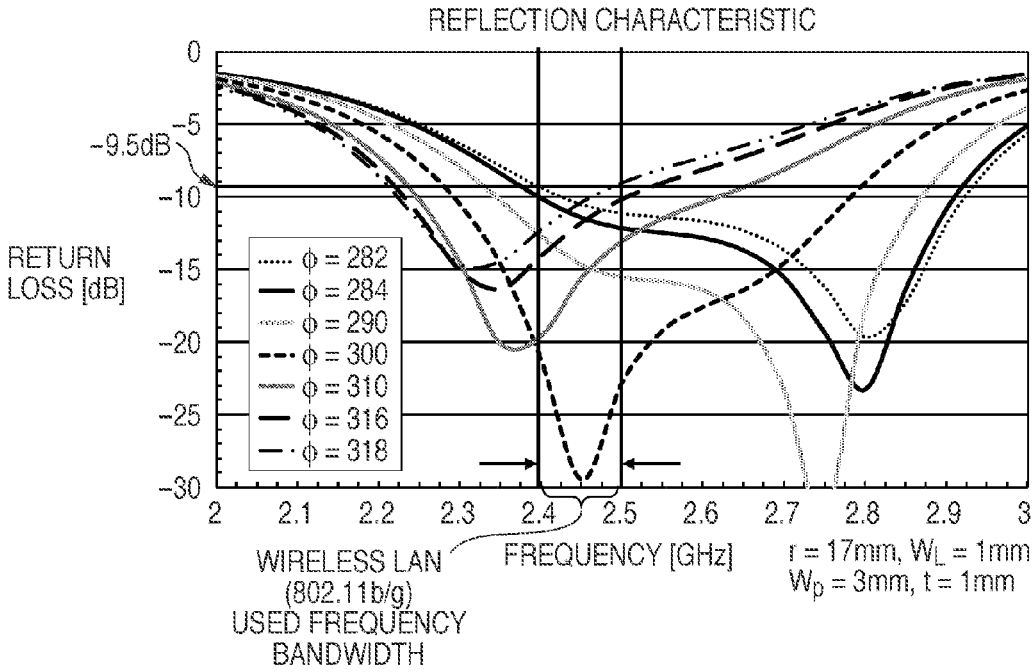
FIG. 3A is a graph showing the simulation result of the reflection characteristic of the loop antenna obtained by changing the opening angle Φ of a parasitic element 103.
Figure 3B:
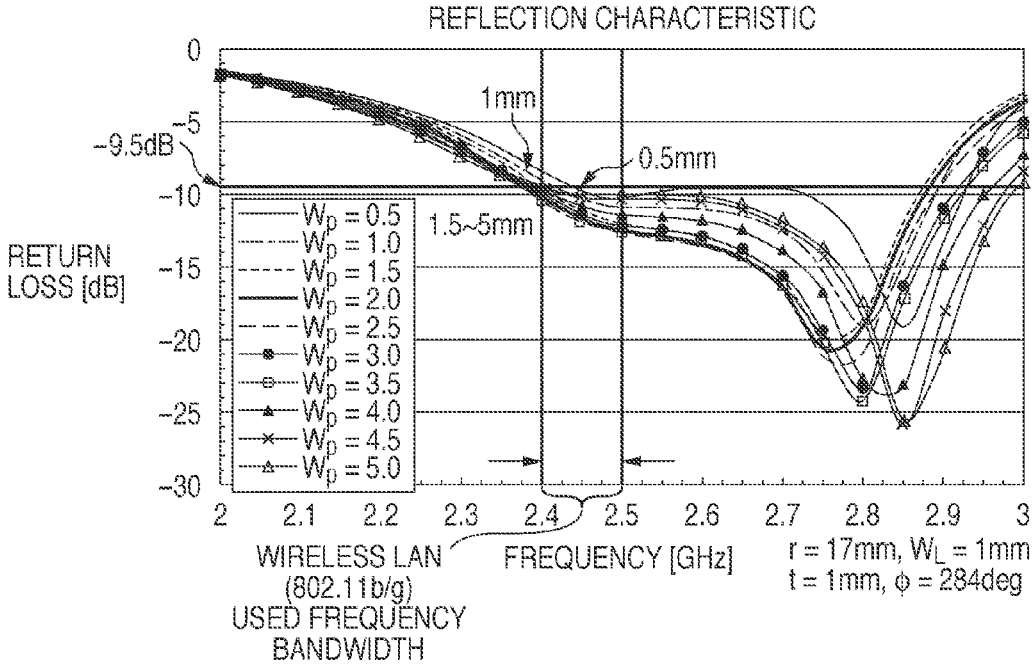
FIG. 3B is a graph showing the simulation result of the reflection characteristic obtained by changing the width $W_p$ of the parasitic element 103 when the opening angle is Φ=284°.

In the third step, the opening angle Φ of the opening portion 105 of the parasitic element 103 and the width $W_p$ of the parasitic element 103 are determined. FIGS. 3A and 3B show the simulation results of the reflection characteristic obtained by connecting the loop element having an input impedance of 75Ω to the high-frequency circuit having a characteristic impedance of 50Ω, and arranging the parasitic element. In FIGS. 3A and 3B, the loop antenna having the loop radius r=17 mm and the width $W_L$=1 mm is used as determined in the first and second steps. FIG. 3A shows the simulation result of the reflection characteristic of the loop antenna obtained by setting the thickness of the dielectric substrate 101 to t=1 mm, temporarily setting the width of the parasitic element 103 to $W_p$=3 mm, and changing the opening angle Φ. As is apparent from FIG. 3A, when the opening angle Φ increases (when the opening portion becomes narrower), the resonance frequency lowers. A return loss of −9.5 dB shown in FIG. 3A is equivalent to a VSWR (Voltage Standing Wave Ratio) of "2". This indicates that approximately 90% the input power is supplied to the antenna. In this embodiment, a VSWR of "2" (return loss: −9.5 dB) or less is set as an index for ensuring the satisfactory characteristic of the loop antenna. The description will be done below assuming that the value of VSWR of the loop antenna is adjusted to "2" or less.

The opening angle Φ at which the return loss is −9.5 dB or less (the VSWR is 2 or less) in the frequency bandwidth of 2.4 to 2.5 GHz is 282° to 318°. When the opening angle Φ is 282°, the return loss is −9.5 dB at 2.4 GHz. When the opening angle Φ is 318°, the return loss is −9.5 dB at 2.5 GHz. For this reason, in this embodiment, the opening angle Φ at which the return loss is lower than −9.5 dB in the bandwidth of 2.4 to 2.5 GHz is 284° to 316°. This opening angle range is defined as the allowable range of the opening angle Φ usable in the bandwidth of 2.4 to 2.5 GHz. When the opening angle Φ is 300°, the reflection characteristic is most excellent in the desired frequency bandwidth (the bandwidth of 2.4 to 2.5 GHz). Hence, the opening angle Φ=300° is the optimum opening angle Φ. The opening portion of the parasitic element has an opening amount with which the VSWR is 2 or less at the used frequency of the loop antenna.

The width $W_p$ of the parasitic element 103 is obtained for each of the minimum value (=284°), the intermediate value (=300°), and the maximum value (=316°) of the allowable range of the opening angle Φ.

FIG. 3B shows the simulation result of the reflection characteristic obtained by changing the width $W_p$ of the parasitic element 103 when the opening angle is Φ=284°. According to FIG. 3B, when the width $W_p$ of the parasitic element 103 is smaller than 1 mm, the return loss exceeds −9.5 dB at part of the bandwidth of 2.4 to 2.5 GHz, and no sufficient characteristic is obtained. As is apparent from FIG. 3B, the width $W_p$ of the parasitic element 103 usable in the desired frequency bandwidth (the bandwidth of 2.4 to 2.5 GHz) is 1.5 to 5 mm. A satisfactory characteristic can be obtained in the desired frequency bandwidth when the width $W_p$ of the parasitic element 103 is larger.

Figure 4A:
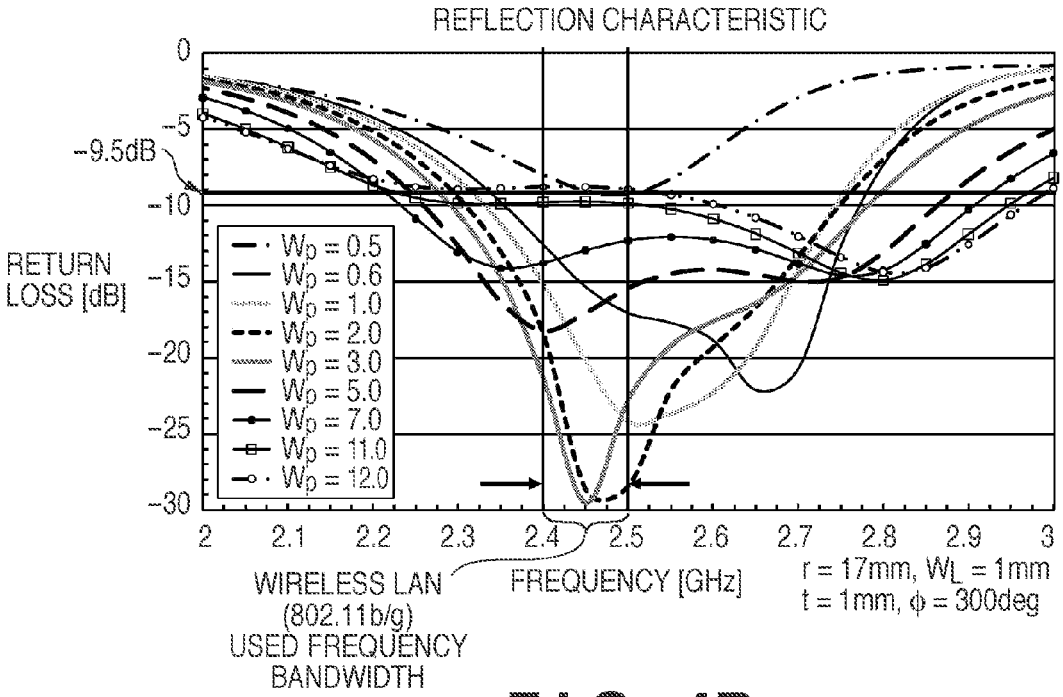
FIG. 4A is a graph showing the simulation result of the reflection characteristic obtained by changing the width $W_p$ of the parasitic element 103 when the opening angle is Φ=300°.

FIG. 4A shows the simulation result of the reflection characteristic obtained by changing the width $W_p$ of the parasitic element 103 when the opening angle is Φ=300°. Referring to FIG. 4A, in this simulation, no sufficient characteristic can be obtained near 2.4 GHz of the desired frequency bandwidth (the bandwidth of 2.4 to 2.5 GHz) when the width $W_p$ of the parasitic element 103 is 0.5 mm. In addition, when the width $W_p$ of the parasitic element 103 is 12 mm, the return loss exceeds −9.5 dB throughout the bandwidth of 2.4 to 2.5 GHz. For these reasons, the effective width $W_p$ of the parasitic element 103 is 0.6 to 11.0 mm. The optimum width $W_p$ of the parasitic element 103, which ensures the most excellent reflection characteristic, is 3 mm.

Figure 4B:
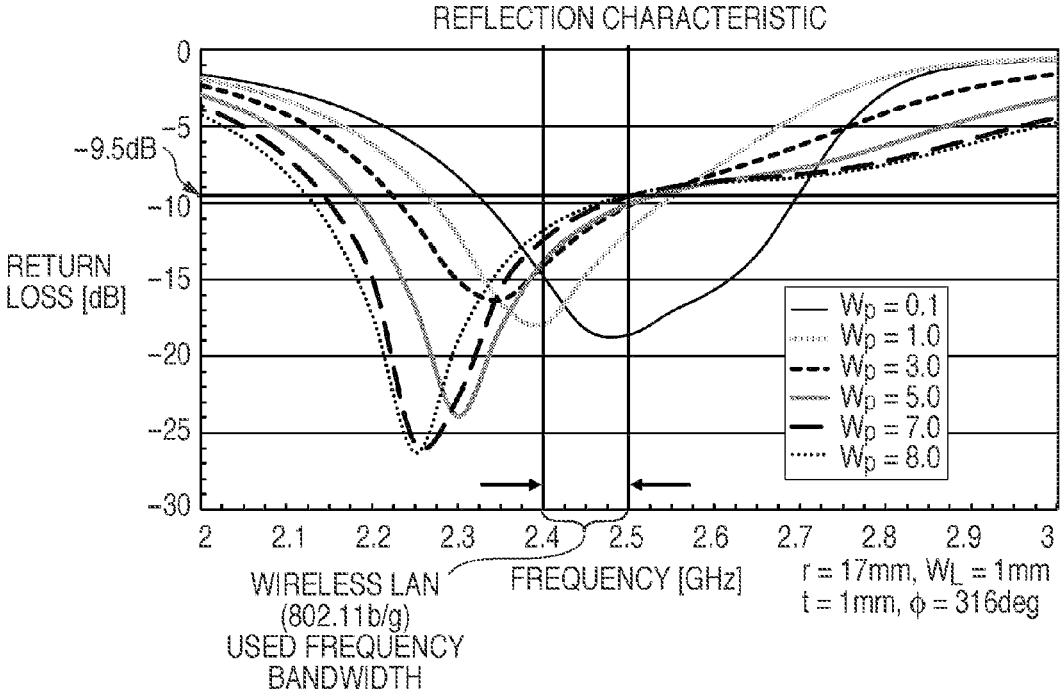
FIG. 4B is a graph showing the simulation result of the reflection characteristic obtained by changing the width $W_p$ of the parasitic element 103 when the opening angle is Φ=316°.

FIG. 4B shows the simulation result of the reflection characteristic obtained by changing the width $W_p$ of the parasitic element 103 when the opening angle is Φ=316°. When the width $W_p$ of the parasitic element 103 is 7.0 mm or 8.0 mm, the return loss is −9.5 dB at 2.5 GHz. When the width $W_p$ of the parasitic element 103 is 5.0 mm, the return loss falls below −9.5 dB throughout the opening portion (the bandwidth of 2.4 to 2.5 GHz). Hence, the width $W_p$ of the parasitic element 103, which ensures the satisfactory reflection characteristic corresponding to the return loss of −9.5 dB or less, is 0.1 to 5.0 mm. The satisfactory characteristic is obtained in the desired frequency bandwidth (the bandwidth of 2.4 to 2.5 GHz) when the width $W_p$ of the parasitic element 103 is smaller. As can be seen from the above result, the optimum opening angle of the parasitic element 103 for the most excellent reflection characteristic is 300°, and the optimum width $W_p$ of the parasitic element 103 is 3 mm. In the desired frequency bandwidth (the bandwidth of 2.4 to 2.5 GHz), the ratio of the width $W_L$ of the loop element 102 to the width $W_p$ of the parasitic element 103 is 1:3.

Figure 5A:
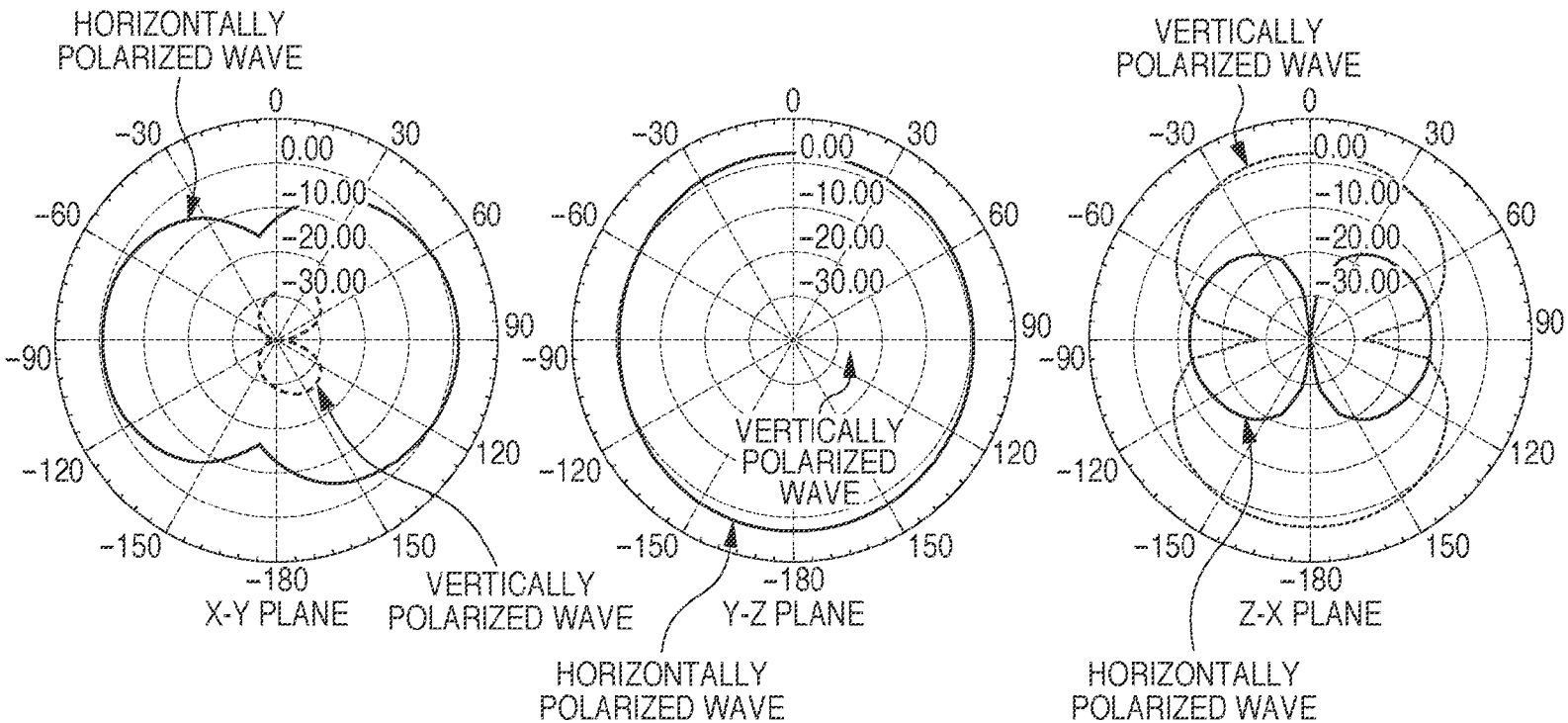
FIG. 5A shows the antenna radiation directional characteristic at a frequency of 2.45 GHz when the opening angle is Φ=300°.
Figure 5B:
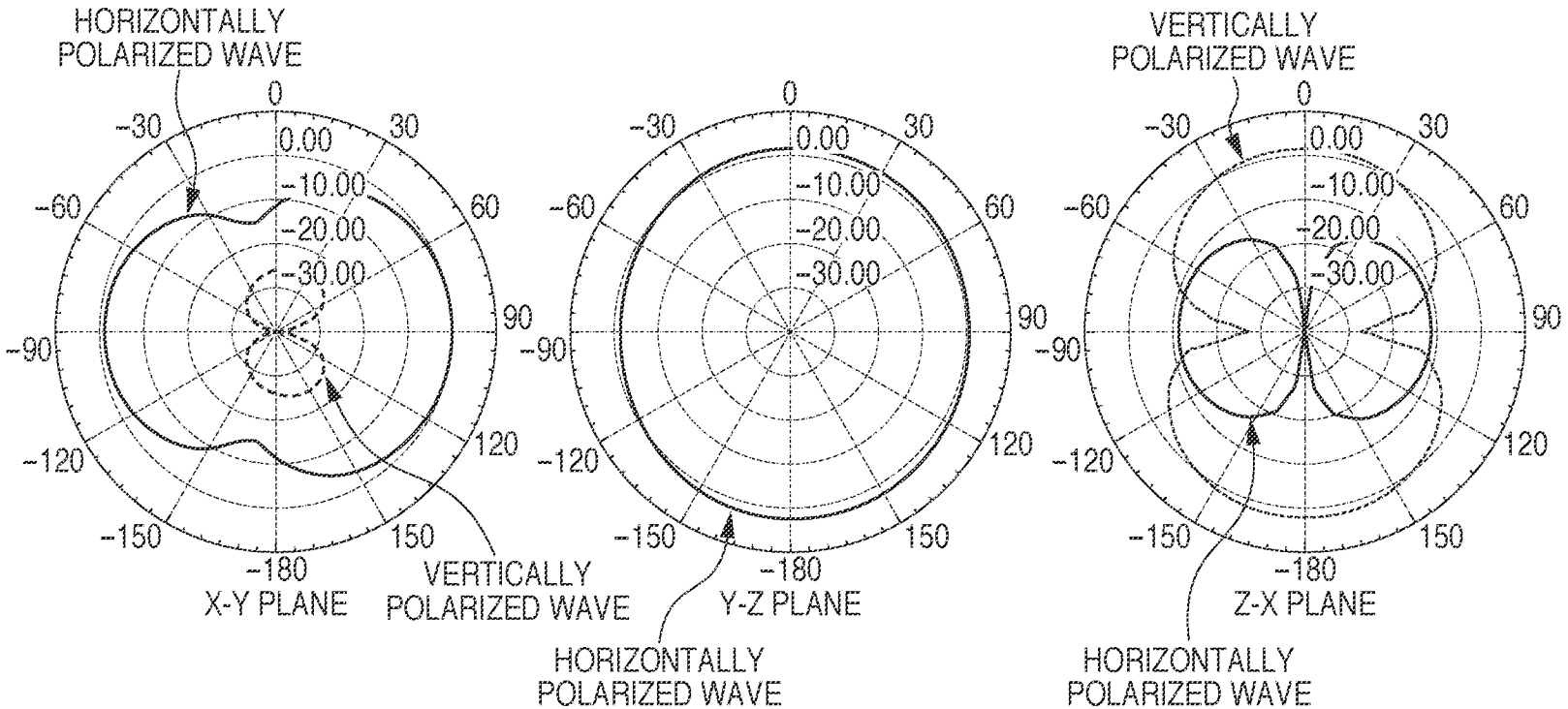
FIG. 5B shows the antenna radiation directional characteristic at the frequency of 2.45 GHz when the opening angle is Φ=316°.
Figure 5C:
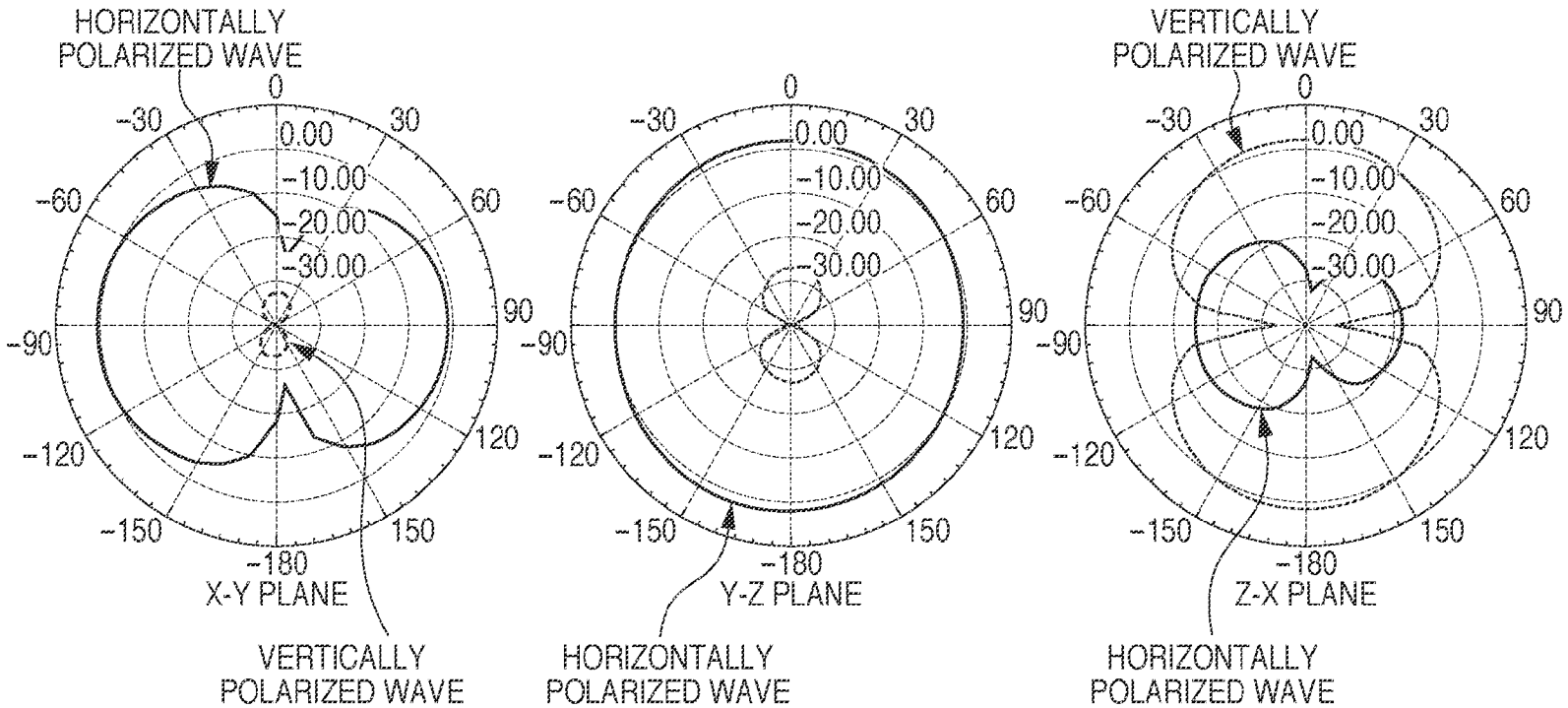
FIG. 5C shows the antenna radiation directional characteristic at the frequency of 2.45 GHz when the stand-alone loop antenna includes no parasitic element.

FIGS. 5A and 5B show the antenna radiation directional characteristics at a frequency of 2.45 GHz when the opening angles are Φ=300° and 316°. For the sake of comparison, FIG. 5C shows the antenna radiation directional characteristic at the frequency of 2.45 GHz when the loop antenna is not connected to the high-frequency circuit and includes no parasitic element 103 (stand-alone loop antenna having an input impedance of 75Ω). As is apparent from FIGS. 5A to 5C, even when the parasitic element 103 is arranged, a satisfactory radiation directional characteristic almost similar to that of the stand-alone loop element 102 is obtained. As can be seen from the comparison of FIGS. 5A and 5B, the radiation directional characteristic does not change even if the opening angle is changed.

In the above-described method of setting the parameters of the loop antenna, the width $W_p$ of the parasitic element 103 is temporarily assumed first. After the opening angle of the parasitic element 103 is determined, the validity of its width $W_p$ is verified. However, these parameters may be designed in the reverse order. That is, the opening angle of the parasitic element 103 may temporarily be assumed first. After the width $W_p$ of the parasitic element 103 is determined, the validity of its opening angle may be verified.

As described above, sequentially designing the radius of the loop element 102 and the opening angle of the parasitic element 103 or sequentially designing the radius of the loop element 102 and the width of the parasitic element 103 allows a loop antenna having a satisfactory reflection characteristic to be designed. Additionally, a loop antenna having a satisfactory reflection characteristic can be designed even on a substrate using another dielectric material or in another frequency bandwidth to be used in wireless communication.

According to this embodiment, it is possible to design a loop antenna having a satisfactory reflection characteristic without providing an impedance conversion unit even when a high-frequency circuit and a loop element having different impedance characteristics are connected and thus provide a loop antenna with a wider frequency bandwidth.

Second Embodiment

Figure 6A:
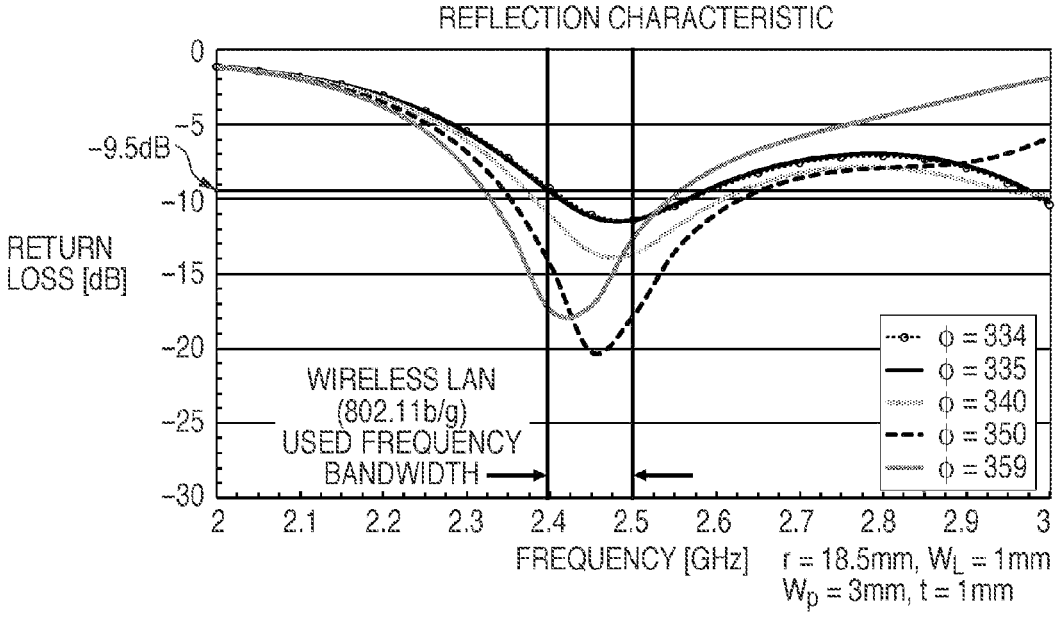
FIG. 6A is a graph showing the simulation result of the reflection characteristic obtained by changing the opening angle Φ of the parasitic element 103.
Figure 6B:
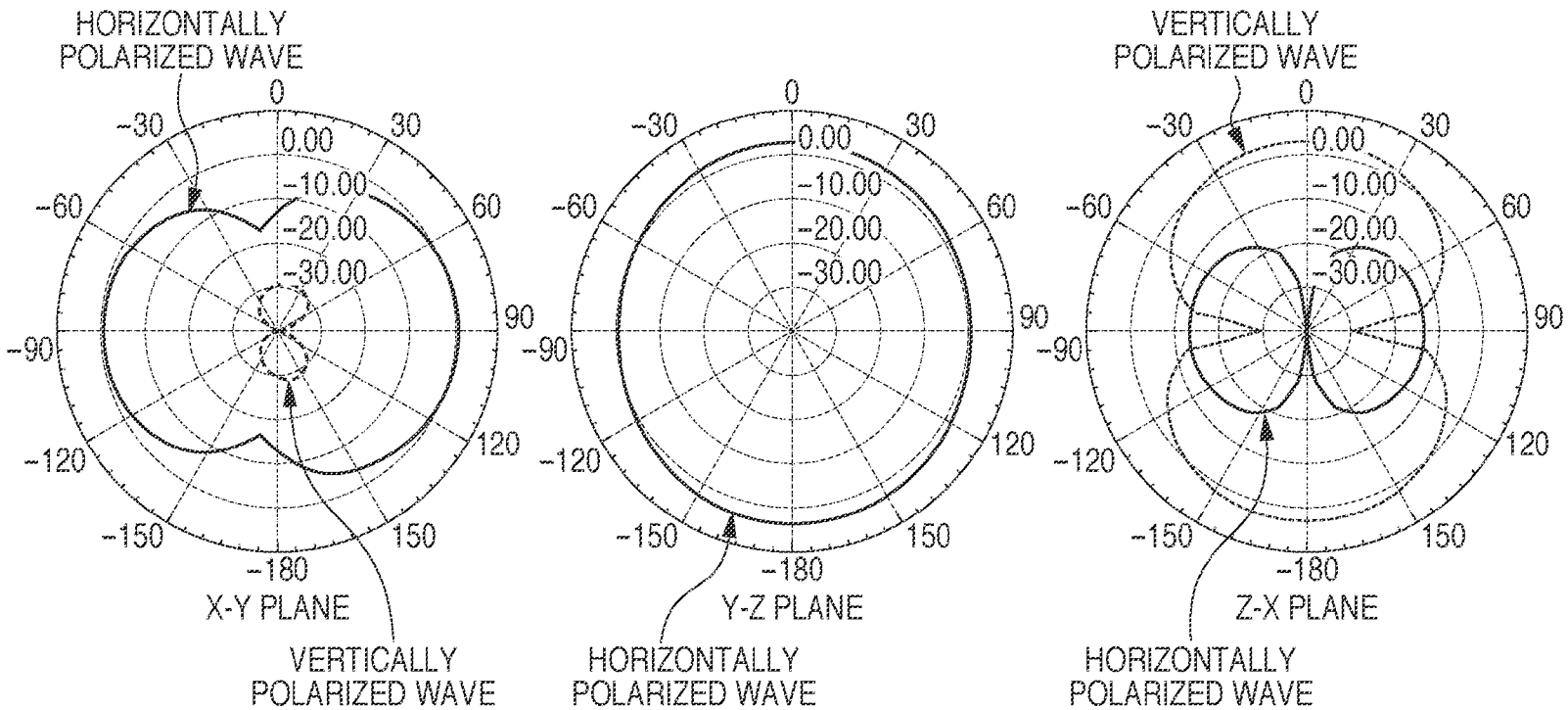
FIG. 6B shows the antenna radiation directional characteristic when the opening angle is optimum: Φ=350°.

In this embodiment, an example will be explained in which Teflon™ is used as a different dielectric material. The arrangement of the loop antenna is the same as in FIGS. 1A to 1C of the first embodiment. Teflon is a material having a dielectric constant smaller than that of glass epoxy used for the dielectric substrate 101 of the first embodiment, and its relative dielectric constant to be used for calculation is assumed to be 2.1 in the simulations. The frequency bandwidth used in wireless communication is 2.4 to 2.5 GHz, as in the first embodiment. The design is done by the same parameter setting method as described in the first embodiment. When the thickness of a dielectric substrate 101 is t=1 mm, the loop radius of a loop element 102 is r=18.5 mm. The loop radius is larger for Teflon than for glass epoxy because the dielectric constant of Teflon is smaller than that of glass epoxy. At this time, the loop width is $W_L$=1 mm, and the width of the parasitic element is $W_p$=3 mm. FIG. 6A shows the simulation result of the reflection characteristic obtained by changing the opening angle of a parasitic element 103. As can be seen from FIG. 6A, when the opening angle Φ is 334° or 335°, the return loss is −9.5 dB at 2.4 GHz. When the opening angle Φ is 340°, the return loss falls below −9.5 dB in the desired frequency bandwidth (the bandwidth of 2.4 to 2.5 GHz). The opening angle, which ensures the satisfactory reflection characteristic corresponding to the return loss of −9.5 dB or less in the frequency bandwidth used in wireless communication, is 340° to 359°. When the opening angle Φ is 350°, the reflection characteristic is most excellent in the desired frequency bandwidth (the bandwidth of 2.4 to 2.5 GHz). Hence, the optimum opening angle Φ is 350°, as is apparent. FIG. 6B shows the antenna radiation directional characteristic when the opening angle is optimum: Φ=350°. The radiation directional characteristic shown in FIG. 5A is similar to that shown in FIG. 6B. It is possible to design a loop antenna having a satisfactory reflection characteristic without changing the radiation directional characteristic even when a different dielectric material is used for the dielectric substrate 101.

Third Embodiment

Figure 7A:
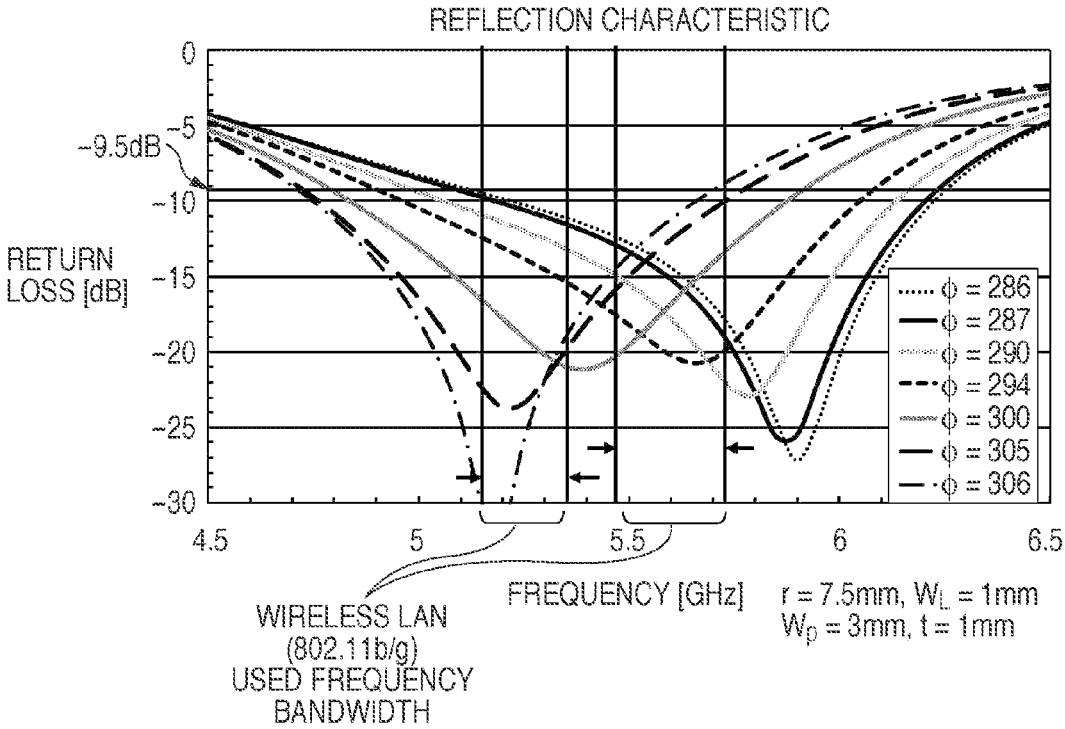
FIG. 7A is a graph showing the simulation result of the reflection characteristic obtained by changing the opening angle Φ of the parasitic element 103.

In this embodiment, an example will be explained in which a frequency different from that of the first embodiment is used as the frequency bandwidth used in wireless communication. In this embodiment, as the frequency bandwidth used in wireless communication, the frequency bandwidths of IEEE802.11a, that is, 5.15 to 5.35 GHz and 5.47 to 5.725 GHz will be described as examples of the desired frequency bandwidth. The arrangement of the loop antenna is the same as in FIGS. 1A to 1C of the first embodiment. A dielectric substrate 101 is made of glass epoxy, as in the first embodiment. The parameters of the loop antenna are designed by the same setting method as described in the first embodiment. When the thickness of the dielectric substrate 101 is t=1 mm, the radius of a loop element 102 is r=7.5 mm. At this time, the center frequency of the frequency bandwidth used in wireless communication is about 5.5 GHz. Hence, the radius of the loop element 102, which causes the loop antenna to resonate at a frequency (about 5.0 GHz) lower than 5.5 GHz by about 500 MHz, is determined to be r=7.5 mm. At this time, the loop width is $W_L$=1 mm, and the width of the parasitic element is $W_p$=3 mm. FIG. 7A shows the simulation result of the reflection characteristic obtained by changing the opening angle. As can be seen from FIG. 7A, when the opening angle Φ is 286°, the return loss is −9.5 dB at 5.15 GHz. When the opening angle Φ is 306°, the return loss exceeds −9.5 dB at 5.75 GHz. The opening angle, which ensures the satisfactory reflection characteristic corresponding to the return loss of −9.5 dB or less in the frequency bandwidth used in wireless communication, is 287° to 305°.

Figure 7B:
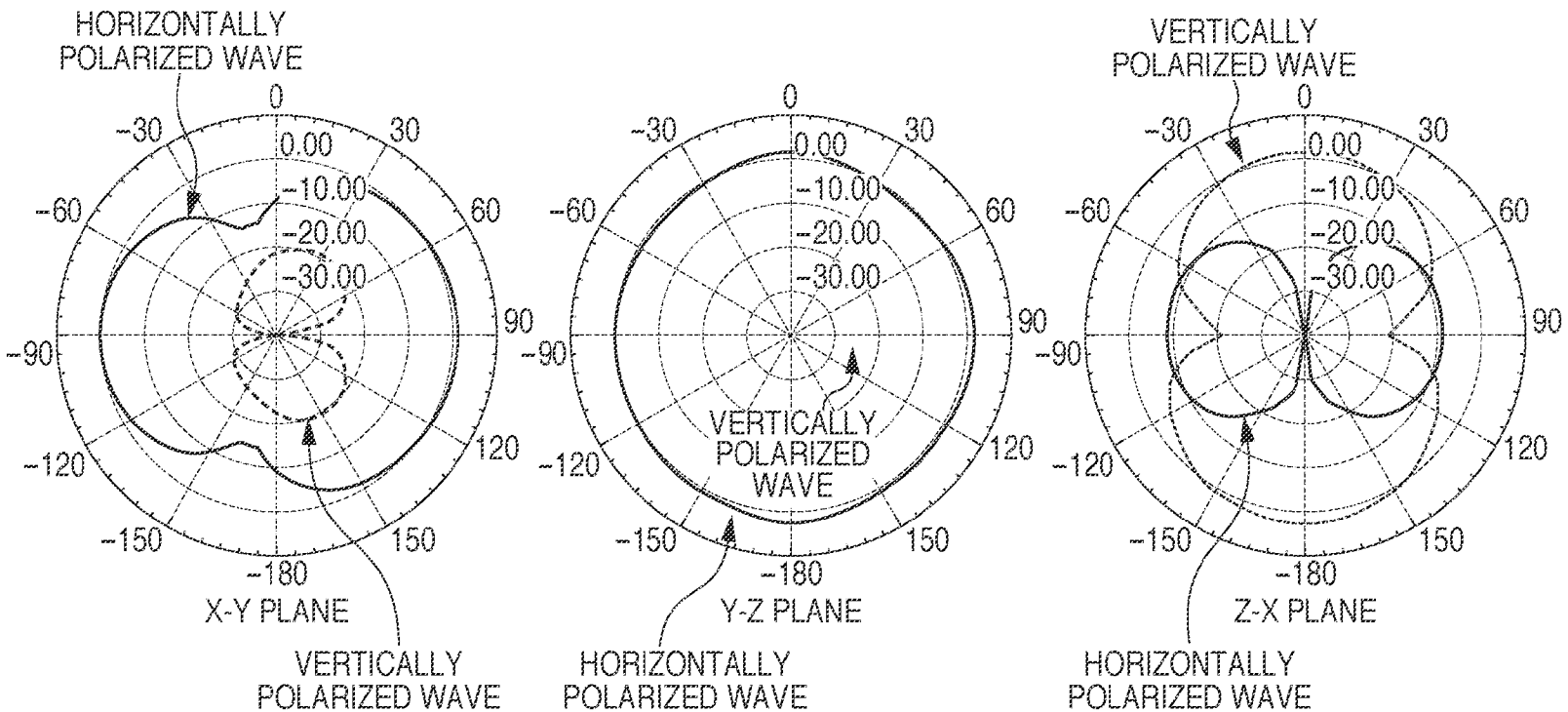
FIG. 7B shows the radiation directional characteristic at a frequency of 5.4 GHz.

FIG. 7B shows the antenna radiation directional characteristic at a frequency of 5.4 GHz when the loop radius is r=7.5 mm, the thickness of the dielectric substrate is t=1 mm, the opening angle is Φ=294°, and the width of the parasitic element 103 is $W_p$=3 mm. The radiation directional characteristic shown in FIG. 5A is similar to that shown in FIG. 7B. There is no influence on the radiation directional characteristic in the opening portion used in wireless communication. It is therefore possible to design a loop antenna having a satisfactory reflection characteristic in a different frequency bandwidth without changing the radiation directional characteristic.

Fourth Embodiment

In the examples of the first to third embodiments, the loop element 102 and the parasitic element 103 of the loop antenna are circular. However, the present invention is not limited to this, and a polygon may also be used. In the fourth embodiment, a loop antenna in which the loop element and the parasitic element are octagonal will be explained. The arrangement of the loop antenna according to the fourth embodiment will be described with reference to FIG. 8A. A regular octagonal loop element 802 of a conductor is arranged on one surface (upper surface) of a dielectric substrate 801, and a regular octagonal parasitic element 803 of a conductor is arranged on the other surface (lower surface) on the other side of the one surface (8*a* and 8*b* in FIG. 8A). The regular octagonal parasitic element 803 and the regular octagonal loop element 802 are arranged such that the line connecting the center point of the regular octagonal parasitic element 803 and that of the regular octagonal loop element 802 is almost concentric and perpendicular to the dielectric substrate 801. Note that the line connecting the center point of the regular octagonal parasitic element 803 and that of the regular octagonal loop element 802 can guarantee a concentric relationship but may be misaligned slightly.

Figure 8A:
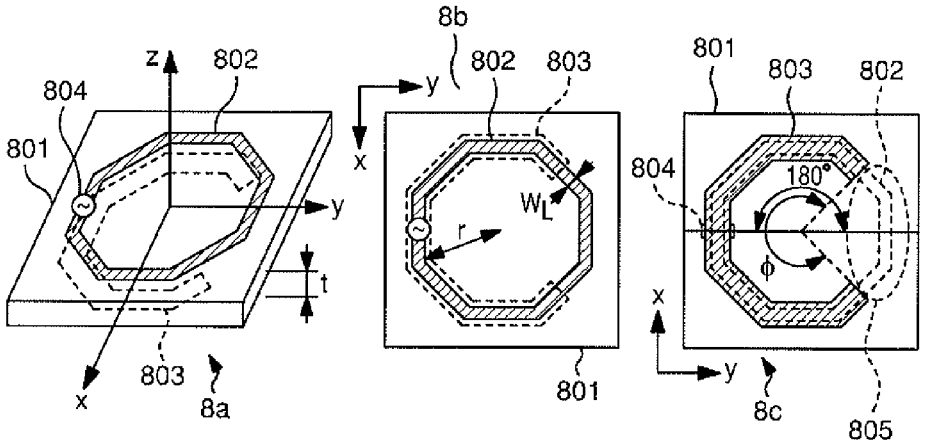
FIG. 8A explains the arrangement of a loop antenna according to the fourth embodiment.

The regular octagonal parasitic element 803 has an opening portion 805 at a position (a position shifted by 180°) opposite to the position of a feeding point 804 of the regular octagonal loop element 802 (8*c* in FIG. 8A).

A radius r indicates the distance (loop radius) from the center to an apex of the regular octagonal loop element 802, and a width $W_L$ indicates the loop width of the regular octagonal loop element 802. An angle Φ indicates the opening angle of the opening portion 805 of the regular octagonal parasitic element 803, and a width $W_p$ indicates the width of the regular octagonal parasitic element 803. A thickness t indicates the thickness of the dielectric substrate 801.

An example will be described in which the dielectric substrate 801 is made of glass epoxy, and the desired frequency bandwidth used in wireless communication is set to 2.4 to 2.5 GHz that is the frequency bandwidth of IEEE802.11b/g, as in the first embodiment.

Figure 8B:
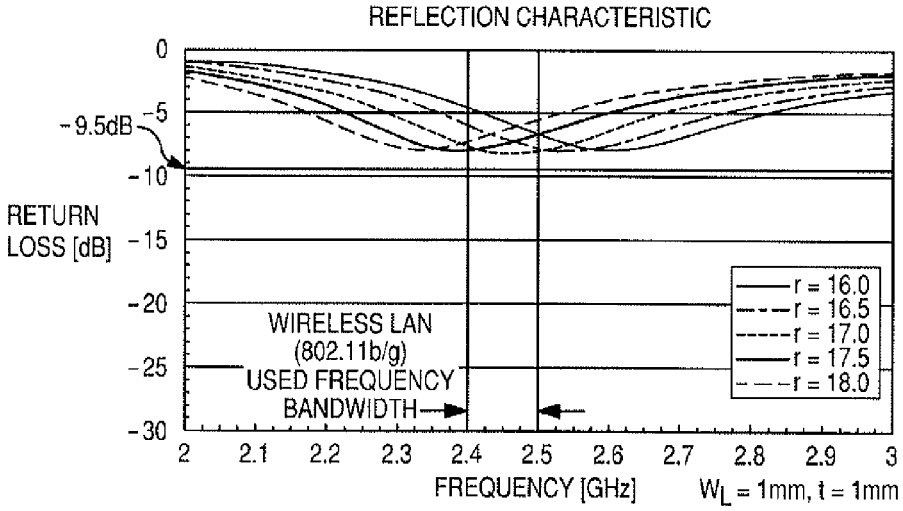
FIG. 8B is a graph showing the simulation result of the reflection characteristic of the loop antenna obtained by changing the loop radius r.

The loop radius r of the regular octagonal loop element 802 is determined from the reflection characteristic of the regular octagonal loop element 802 and the dielectric substrate 801 without arranging the regular octagonal parasitic element 803. FIG. 8B shows the simulation result of the reflection characteristic of the loop antenna obtained by changing the loop radius r when a loop element having an input impedance of 75Ω is connected to a high-frequency circuit having a characteristic impedance of 50Ω, and no parasitic element is arranged.

Figure 9A:
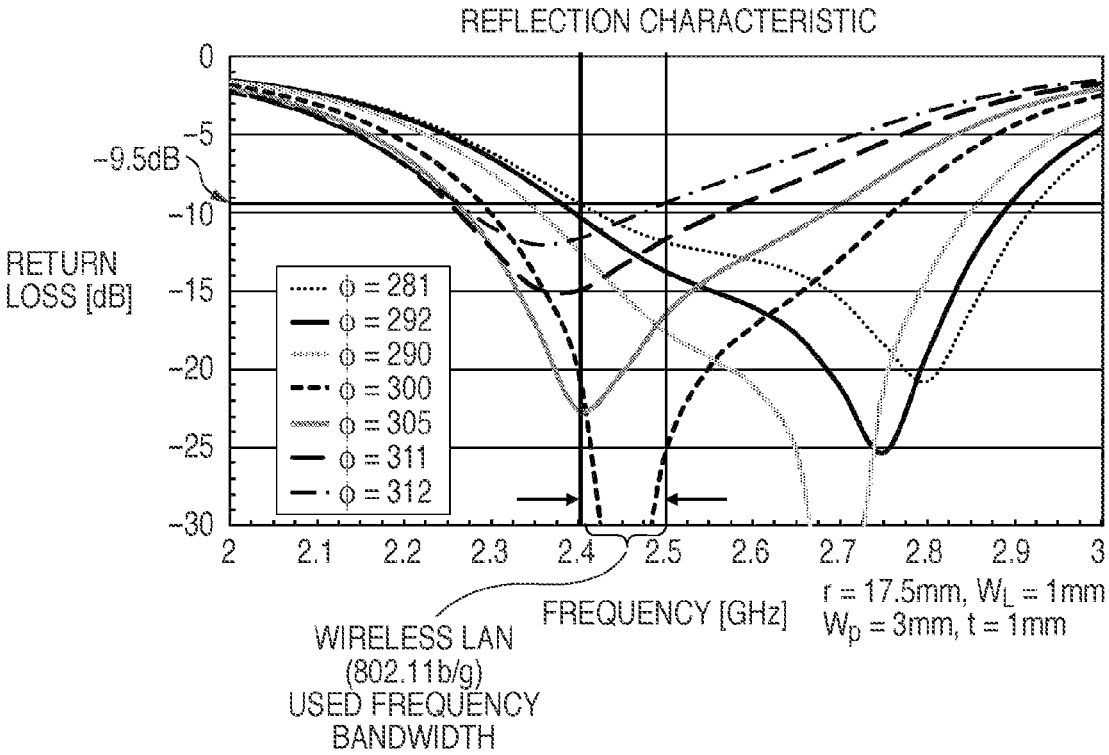
FIG. 9A is a graph showing the simulation result of the reflection characteristic of the loop antenna obtained by changing the opening angle Φ when the thickness of a dielectric substrate 101 is t=1 mm.

In accordance with the same procedure as in the first embodiment, the loop radius r is determined such that the resonance frequency is set to a frequency lower than the center frequency of the desired frequency bandwidth by 5% to 10%. As can be seen from FIG. 8B, for example, r=17.5 mm is determined as the loop radius that causes the loop antenna to resonate at a frequency lower than 2.45 GHz that is the center frequency of the desired frequency bandwidth by about 5% (about 100 MHz). The remaining parameters can be determined in accordance with the same procedure as in the first embodiment. FIG. 9A shows the simulation result of the reflection characteristic of the loop antenna obtained by changing the opening angle when the width is $W_L$=1 mm, the width of the regular octagonal parasitic element 803 is $W_p$=3 mm, and the thickness of the dielectric substrate 801 is t=1 mm. As is apparent from FIG. 9A, the opening angle at which the return loss is −9.5 dB or less is 282° to 311°. The optimum opening angle which ensures the most excellent reflection characteristic in the desired frequency bandwidth is 300°.

Figure 9B:
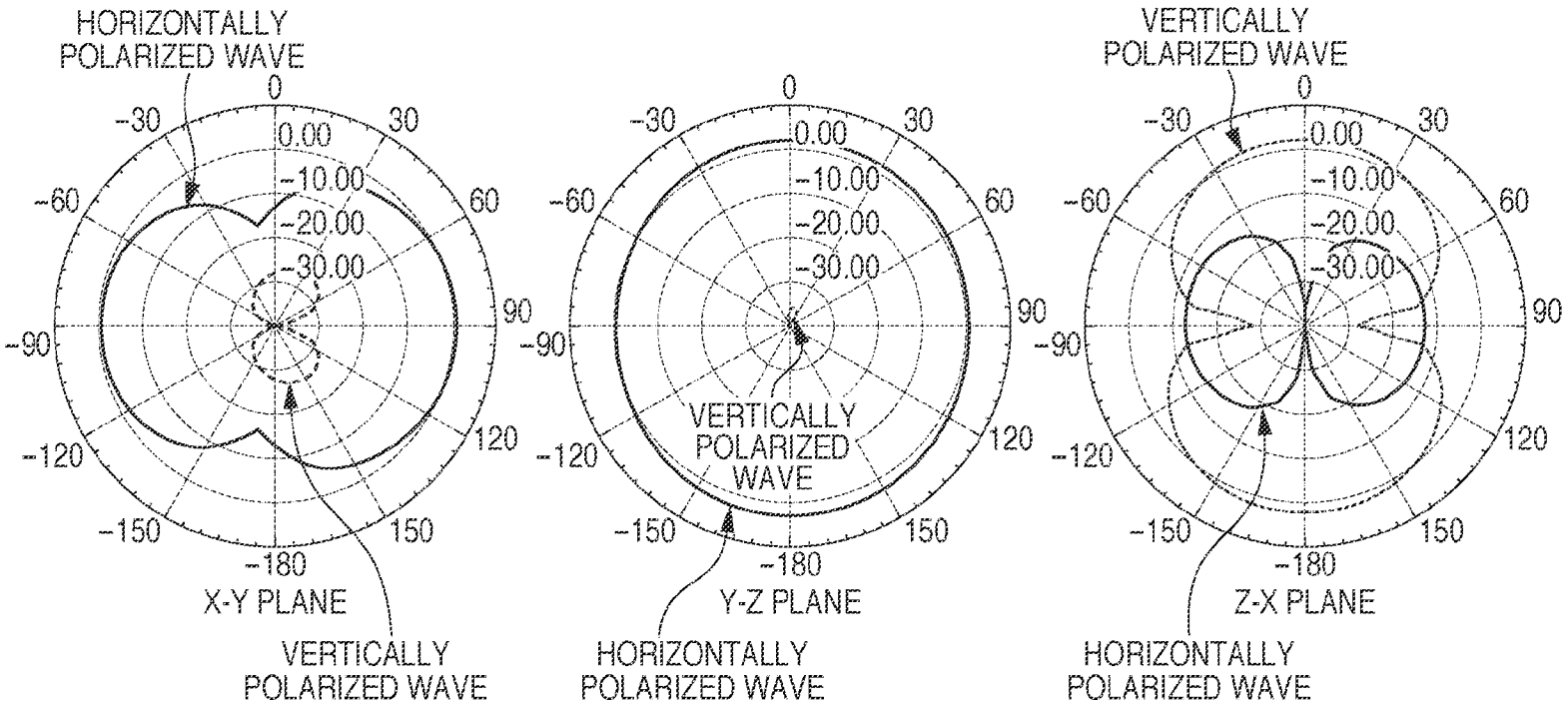
FIG. 9B shows the radiation directional characteristic of the loop antenna at the center frequency 2.45 GHz of a desired frequency bandwidth when the opening angle is optimum: Φ=300°.
Figure 9C:
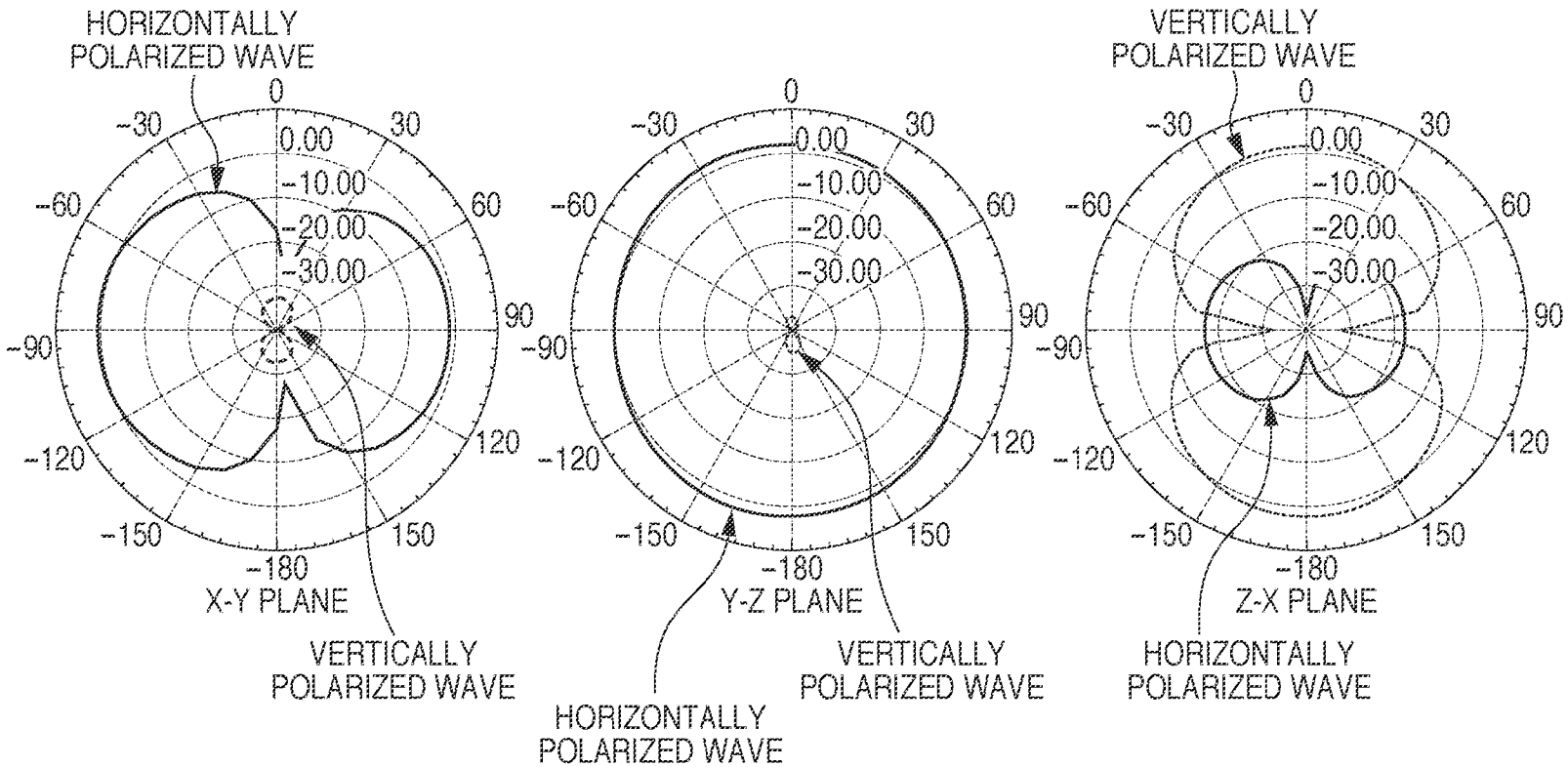
FIG. 9C shows the radiation directional characteristic of a stand-alone octagonal loop antenna having no regular octagonal parasitic element 803.

FIG. 9B shows the radiation directional characteristic of the loop antenna at the center frequency 2.45 GHz of the desired frequency bandwidth when the optimum opening angle is Φ=300°. For the sake of comparison, FIG. 9C shows the radiation directional characteristic of a stand-alone octagonal loop antenna which includes no regular octagonal parasitic element 803. As is apparent from FIGS. 9B and 9C, the radiation directional characteristic of the octagonal loop antenna of this embodiment including the regular octagonal parasitic element 803 is similar to that of the stand-alone octagonal loop antenna. That is, adding the regular octagonal parasitic element 803 does not affect the radiation directional characteristic in the octagonal loop antenna as well.

In this embodiment, the regular octagon has been exemplified as a different shape. However, it is possible to obtain the satisfactory reflection characteristic in a polygonal loop antenna in accordance with the same procedure. In the above-described first to fourth embodiments, the thickness of the dielectric substrate is 1 mm. However, the present invention is not limited to this example. Even when the dielectric substrate has a different thickness, a loop antenna having a satisfactory reflection characteristic corresponding to the return loss of −9.5 dB or less can be designed in accordance with the same procedure.

In the first to fourth embodiments, dielectric substrates made of glass epoxy and Teflon, frequency bandwidths of IEEE802.11b/g and IEEE802.11a, and loop antennas having circular and regular octagonal shapes have been exemplified. However, the present invention is not limited to those examples. Applying the setting methods (design procedures) of the parameters of the loop antenna according to the first to fourth embodiments enables to similarly design a loop antenna using another dielectric material, frequency bandwidth, or loop antenna shape.

According to this embodiment, it is possible to provide a loop antenna having a wider frequency bandwidth and connectable to a circuit having an impedance characteristic of a predetermined value such as 50Ω without providing an impedance conversion unit.

According to each of the above-described embodiments, a loop element and a parasitic element are arranged on a dielectric substrate in an almost concentric relationship. The parasitic element has an opening portion smaller than the half perimeter of the loop element at a position on the half perimeter opposite to the position of the feeding point of the loop element. In other words, the parasitic element is arranged at a position opposite to the loop surface of the loop element in an almost concentric relationship to the loop element. The parasitic element has an opening portion smaller than the half perimeter of the loop element at a position on the loop perimeter opposite to the position of the feeding point on the loop perimeter of the loop element. With this arrangement, suitable characteristics can be obtained even when the loop antenna is connected to a circuit having a different impedance characteristic.

Other Embodiments

The method of designing the parameters of the loop antenna of the present invention can also be implemented by executing the following processing. That is, software (program) that implements the functions of the above-described embodiments is supplied to a system or apparatus via a network or various kinds of storage media, and the computer (or CPU or MPU) of the system or apparatus reads out and executes the program.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-159166, filed Jul. 13, 2010 and 2011-118398, filed May 26, 2011, which are hereby incorporated by reference herein in their entirety.

What is claimed is:

1. A loop antenna comprising:

a loop element arranged on one surface of a dielectric substrate and having a feeding point; and a parasitic element arranged, on the other surface which is a surface on the other side of the one surface of the dielectric substrate, to be substantially concentric to said loop element and having an opening portion smaller than a half perimeter of said loop element, the opening portion being formed at a position opposite to a position where the feeding point is provided.

2. The antenna according to claim 1, wherein a radius of said loop element is determined so as to cause the loop antenna to resonate at a frequency lower than a center frequency of a frequency bandwidth used in wireless communication by the loop antenna by 5% to 10%.

3. The antenna according to claim 2, wherein a width of said loop element is determined so as to cause the loop antenna to resonate at a frequency within the frequency bandwidth used in wireless communication by the loop antenna.

4. The antenna according to claim 3, wherein a ratio of the width of said loop element to a width of said parasitic element is 1:3.

5. The antenna according to claim 1, wherein said loop element and said parasitic element are formed from a conductor.

6. The antenna according to claim 1, wherein an opening amount of the opening portion of said parasitic element ensures a voltage standing wave ratio of not more than 2 at a used frequency of the loop antenna.

* * * * *